US007392625B2

(12) United States Patent
Bruggink et al.

(10) Patent No.: US 7,392,625 B2
(45) Date of Patent: Jul. 1, 2008

(54) NAIL FIN FOR WINDOW FRAME ASSEMBLY

(75) Inventors: Bradley J. Bruggink, Plymouth, WI (US); Steve Laumann, Cameron, WI (US)

(73) Assignee: Wisconsin Plastic Products, Inc., Plymouth, WI (US)

( * ) Notice: Subject to any disclaimer, the term of this patent is extended or adjusted under 35 U.S.C. 154(b) by 0 days.

(21) Appl. No.: 11/487,114

(22) Filed: Jul. 14, 2006

(65) Prior Publication Data

US 2008/0010918 A1 Jan. 17, 2008

(51) Int. Cl.
*E06B 3/00* (2006.01)
*E06B 1/04* (2006.01)

(52) U.S. Cl. ..... 52/204.55; 52/214

(58) Field of Classification Search ..... 52/204.1, 52/716.1, 212, 211, 204.55, 213, 717.01, 52/656.5, 656.6, 204.5, 204.51, 204.62, 716.6, 52/717.05, 214, 204.53, 717.04, 741.4; 49/504, 49/467, 468, 469, 472; 428/461, 462, 465
See application file for complete search history.

(56) References Cited

U.S. PATENT DOCUMENTS 2,863,534 A 12/1958 Gillespie
3,103,710 A * 9/1963 Fredricksen ..... 52/211
3,473,266 A 10/1969 Miller
3,694,961 A 10/1972 Johnson
4,122,633 A 10/1978 Holdiman
4,207,707 A 6/1980 Holdiman et al.
4,237,664 A 12/1980 Wilmes
4,310,164 A * 1/1982 Mesnel ..... 277/642
4,578,905 A 4/1986 Hout
4,821,472 A * 4/1989 Tix ..... 52/204.55
4,958,469 A * 9/1990 Plummer ..... 52/204.55
4,999,957 A * 3/1991 Kessler ..... 52/213
5,119,609 A * 6/1992 Tait et al. ..... 52/213
5,210,986 A * 5/1993 Hagemeyer et al. ..... 52/211
5,590,496 A * 1/1997 Martin et al. ..... 52/213
5,619,828 A * 4/1997 Ver Meer ..... 52/213
5,722,207 A * 3/1998 Anderson et al. ..... 52/204.55
5,791,104 A * 8/1998 Baier et al. ..... 52/217
6,119,416 A 9/2000 Larson
6,148,584 A * 11/2000 Wilson ..... 52/717.01

(Continued)

FOREIGN PATENT DOCUMENTS

JP 09268844 A * 10/1997

*Primary Examiner*—Robert Canfield
*Assistant Examiner*—Ryan D Kwiecinski
(74) *Attorney, Agent, or Firm*—Andrus, Sceales, Starke & Sawall, LLP

(57) ABSTRACT

A nail fin is adapted to be used with a fenestration frame assembly adapted to be fastened in a building support structure. The nail fin includes a substantially bendable metallic flange member having an anchor portion adapted to be retained in the frame assembly and pivotally connected to an attachment portion adapted to be fastened to the support structure along a hinge defined by a series of spaced apart openings formed through the flange member. The metallic flange member is formed with a coextruded first strip covering the openings and defining barbed elements around the anchor portion. The metallic flange member is formed with a second coextruded strip defining a solid attachment template adapted to be fastened to the support structure and forming a seal adapted to be engaged against the support structure.

13 Claims, 3 Drawing Sheets

U.S. PATENT DOCUMENTS

| | | | | |
|---|---|---|---|---|
| 6,223,484 | B1 | 5/2001 | Minter | |
| 6,393,779 | B1 * | 5/2002 | Boldt | 52/210 |
| 2002/0059760 | A1 * | 5/2002 | Heard et al. | 52/211 |
| 2003/0213196 | A1 * | 11/2003 | Harel | 52/287.1 |
| 2007/0220818 | A1 * | 9/2007 | Teodorovich | 52/204.1 |

* cited by examiner

NAIL FIN FOR WINDOW FRAME ASSEMBLY

FIELD OF THE INVENTION

The present invention relates generally to nail fins used in the construction industry to secure a frame assembly, such as a window or door assembly, to a surrounding support structure. More particularly, the invention relates to a foldable nail fin which in addition to the above function, provides enhanced sealing and attachment capability.

BACKGROUND OF THE INVENTION

Most commercial fenestration products (e.g. doors and windows) are provided with factory installed circumscribing frames. These frames are normally equipped with nail fins which are initially attached in a recessed or flattened condition adjacent the outer frame surfaces. In use, the fins are manually pivoted outwardly through essentially a 90 degree arc so as to form outwardly extending projections about the door or window frame. During installation, the door or window assembly is mounted in an approximate rough opening in the building wall, and nails or screws are installed through the fins to attach the door or window assembly in place.

Known fin designs are manufactured with various insertion leg configurations for anchoring and retaining the fin in the door or window frame assembly. Existing fins are also manufactured with a series of openings through the fin body to define a fold line or hinge. The openings are covered with a tape which is designed to prevent water leakage through the holes where the fenestration product is installed in a building. In addition, nail holes are typically formed in the fin body to facilitate the attachment of the fins to the building wall or support structure.

When using these known fins, manufacturing costs are affected by the inclusion of the various insertion leg configurations, sealing tape and nail hole formation. In addition, the sealing tape can be dislodged or punctured during the installation process, thereby presenting a leakage problem. Further leakage problems may occur in the area where the fin is attached to the building wall or support structure.

Accordingly, there is a need in the art for an improved nail fin which addresses the cost, sealing and attachment concerns created by the prior art design.

SUMMARY OF THE INVENTION

The present invention relates to a nail fin adapted to be used with a fenestration frame assembly adapted to be fastened in a building support structure. The nail fin includes a substantially rigid, bendable, metallic flange member having an anchor portion adapted to be retained in the frame assembly and pivotally connected to an attachment portion adapted to be fastened to the support structure along a hinge defined by a series of spaced apart openings formed through the flange member. The metallic flange member is formed with a coextruded strip covering the openings and defining barbed elements around the anchored portion.

The attachment portion of the metallic flange member is formed with another coextruded strip defining a solid attachment template adapted to be fastened to the support structure and forming a seal adapted to be engaged against the support structure. The flange member is preferably constructed of galvanized steel, and the coextruded strips are constructed of thermoplastic elastomer.

In one aspect of the invention, a nail fin is adapted to interconnect a peripheral frame assembly with a support structure. The nail fin includes an L-shaped bendable member constructed of a substantially stiff material having a bent inner portion provided with a horizontal leg connected to a vertical leg, and a straight outer portion with an inner end lying coplanar with the horizontal leg and pivotally interconnected with the inner portion by a hinge defined by a series of spaced apart openings formed through the bendable member. At least a first strip covers the hinge and extends along outer surfaces of the outer portion, the horizontal leg and the vertical leg as well as an inner surface of the vertical leg for sealing the openings and integrally forming barbed elements adapted to be frictionally retained in the peripheral frame assembly.

A second strip is provided along an outer end of the outer portion for defining a solid attachment template adapted to be fastened to the support structure and forming a seal adapted to be engaged against the support structure. The bendable member is preferably constructed of galvanized steel. The horizontal leg is integrally joined to the vertical leg at a 90 degree angle. The first and second strips are constructed of a flexible thermoplastic elastomer coextruded along opposite ends of the bendable member. The second strip includes a planar portion and a deflectable sealing finger disposed at an angle relative to the planar portion. The bendable member has a shipping position in which the outer portion is adapted to lie along an outer surface of the peripheral frame assembly, and an installed position in which the outer portion is adapted to be attached to the support structure at an angle of 90 degrees relative to the outer surface of the peripheral frame assembly. The outer portion has a length which is longer than the inner portion. The seal includes a portion that extends along an inner surface of the outer end. The bendable member has a substantially uniform thickness throughout a length and a width thereof. The bendable member is constructed of a material different than the first and second strips.

The invention further contemplates a method for providing a nail fin between a fenestration product frame assembly and a building support structure. The method includes the steps of: a) supplying a substantially bendable metallic flange member having an anchor portion pivotally connected to an attachment portion along a hinge defined by a series of openings formed through the flange member; b) coextruding a first flexible strip on the flange member covering the openings and forming barbed elements around the anchor portion; c) coextruding a second flexible strip on the attachment portion of the flange member spaced from the first flexible strip with the second flexible strip having a solid attachment template and a deflectable seal; d) positioning the flange member such that the anchor portion and the barbed elements are frictionally retained in a channel formed in an outer surface of the frame assembly, and the attachment portion extends along the outer surface of the frame assembly; e) bending the attachment portion with the second strip away from the outer surface of the frame assembly such that the attachment portion lies substantially perpendicular to the outer surface of the frame assembly; and f) fastening the attachment portion through the solid attachment template to the support structure such that the seal engages the support structure.

BRIEF DESCRIPTION OF THE DRAWINGS

The drawings illustrate the best mode presently contemplated of carrying out the invention.

In the drawings.

DETAILED DESCRIPTION OF THE INVENTION

The present invention relates to a nail fin for use with a window, door or other similar fenestration product enclosed by or having a peripheral frame. Although the preferred embodiment illustrates a nail fin in use with a window frame assembly, it should be understood that use of the nail fin is not restricted to that singular application. As such, the following description is not intended to limit the scope of the invention.

Figure 3:
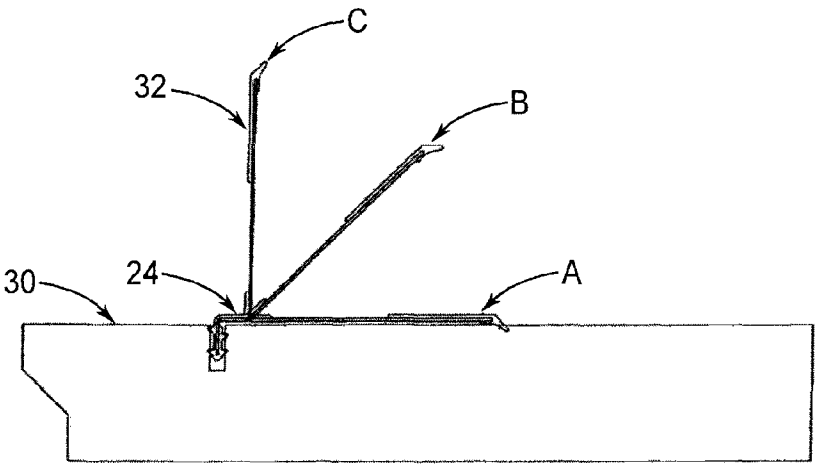
FIG. 3 is an elevational view of a nail fin in a shipping position, in an intermediate installation position and in a final installation position as the nail fin is retained in the window frame assembly.
Figure 2:
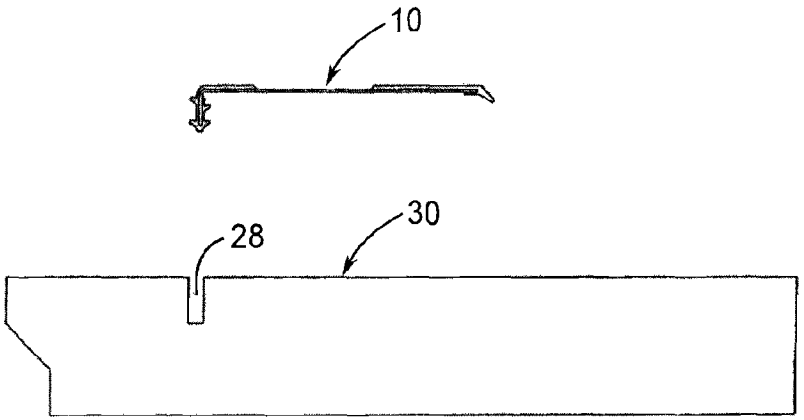
FIG. 2 is an exploded, elevational view of a nail fin and a window frame assembly.
Figure 1:
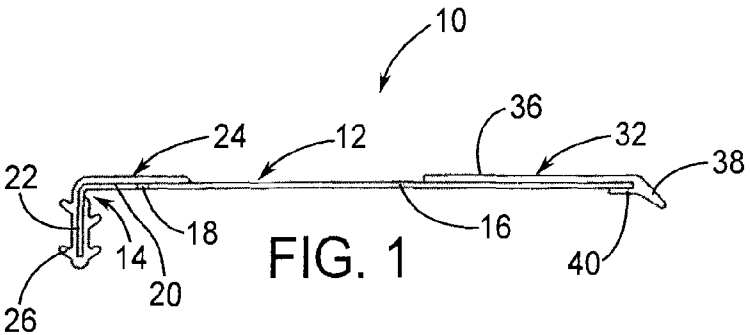
FIG. 1 is an elevational view of a nail fin formed in accordance with the present invention.
Figure 5:
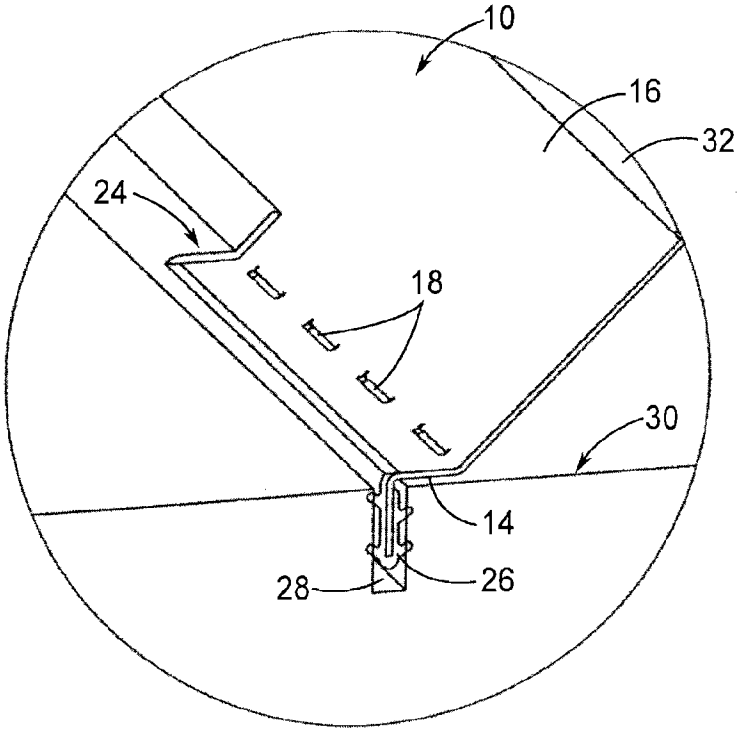
FIG. 5 is an enlarged detail view taken on line 5-5 of FIG. 4.
Figure 4:
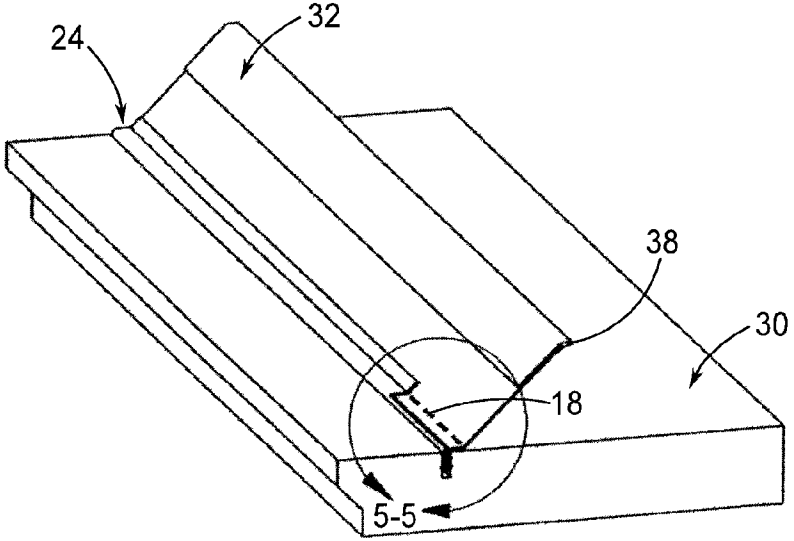
FIG. 4 is a perspective view of FIG. 3 in the intermediate installation position, with parts of a nail fin removed for clarity.
Figure 7:
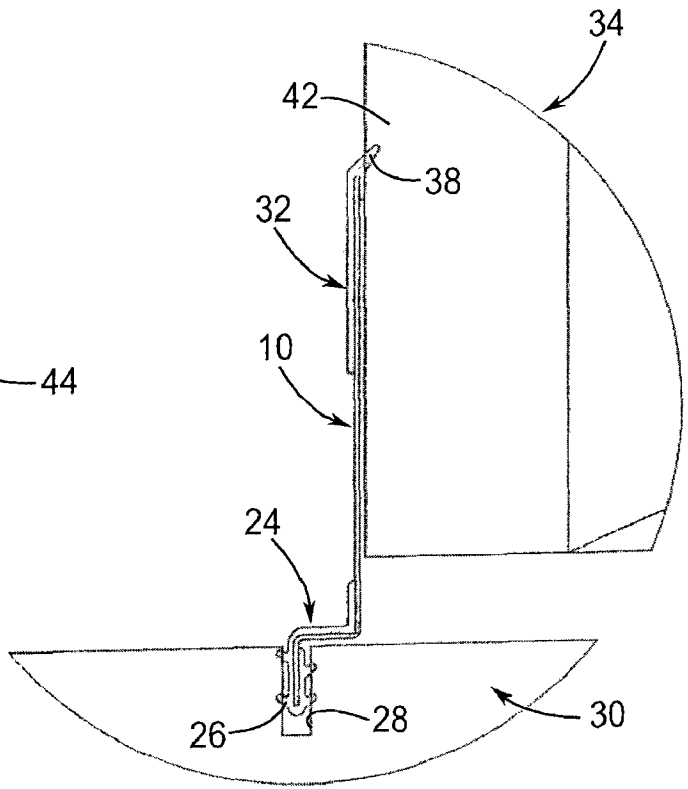
FIG. 7 is an enlarged detail view taken on line 7-7 of FIG. 6.
Figure 6:
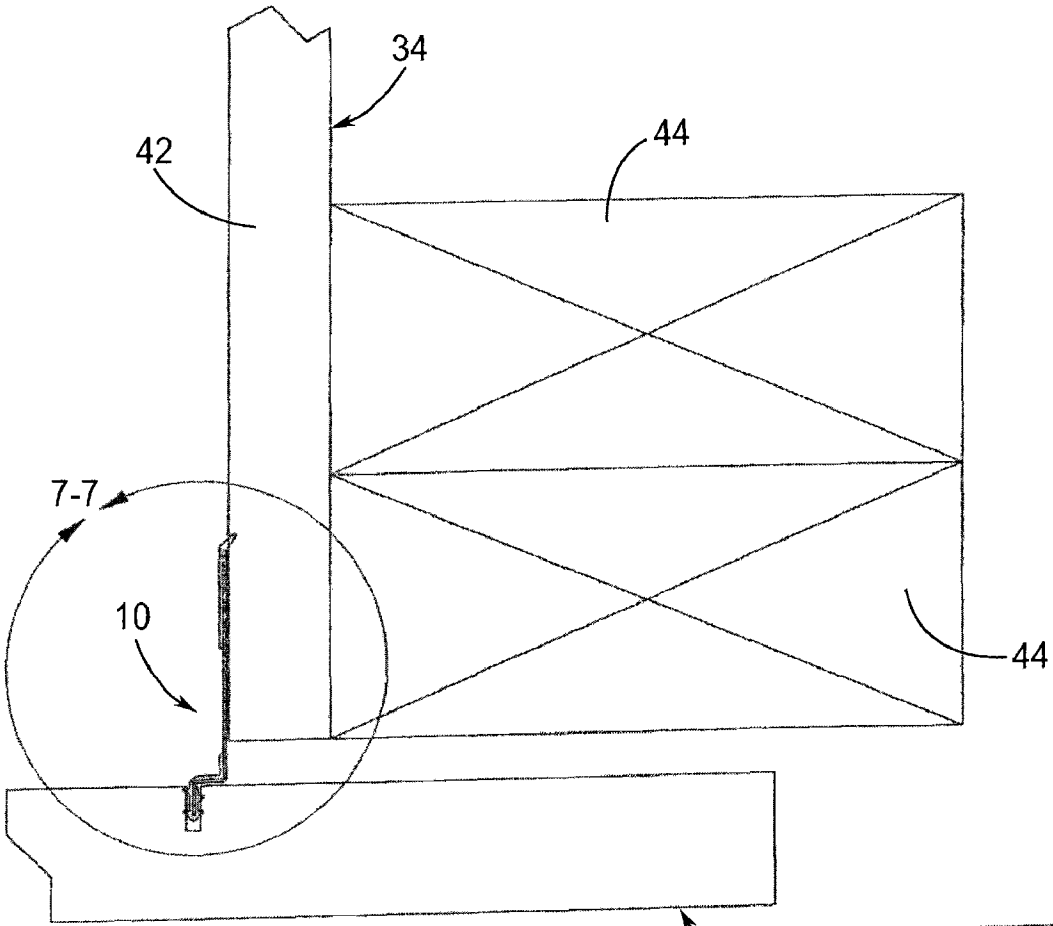
FIG. 6 is an elevational view of the nail fin in the final installation position attached to a building support structure.

Referring to FIGS. 1-7, thereshown is a nail fin 10 formed in accordance with the present invention. The nail fin 10 is comprised of an L-shaped, thin flange member 12 constructed of a substantially rigid or stiff bendable metal, such as galvanized steel. The flange member 12 is formed with a generally constant thickness throughout its width and length, and includes an inner or anchor portion 14, and an outer or attachment portion 16. The inner and outer portions 14, 16, respectively are pivotally interconnected together along a hinge defined by a series of spaced apart rectangular openings 18 formed through the flange member 12 across its width. The inner portion 14 has a straight horizontal leg 20 connected to a straight vertical leg 22 at a 90 degree angle. The outer portion 16 is straight and lies coplanar with the horizontal leg 20 of inner portion 14. The outer portion 16 has a length which is longer than a length of the inner portion 14.

A first flexible strip 24 covers a hinge formed by openings 18, and is coextruded along outer surfaces of the outer portions 16, the horizontal leg 20 and the vertical leg 22 as well as along an inner surface of the vertical leg 22. The first coextruded strip 24 serves to seal the openings 18 to prevent the passage of moisture therethrough. In addition, the first strip 24 is integrally formed with barbed elements 26 around the vertical leg 22 adapted to be frictionally retained in a kerf or channel 28 formed in an outer surface of a window frame assembly 30.

A second flexible strip 32 is coextruded along an outer end of the outer portion 16 for defining a solid attachment template adapted to be fastened to a building support structure 34 (FIGS. 6-7), and forming a deflectable seal adapted to be engaged tightly against the support structure 34. The second strip 32 has a planar portion 36 forming the attachment template and a deflectable sealing finger 38 disposed at an angle relative to the planar portion 36. The sealing finger 38 has a portion 40 that extends along an inner surface of the outer end of the outer portion 16. The first and second strips 24, 32, respectively, are thus coextruded at opposite ends of the flange member 12, and are preferably formed as a rubber-like thermoplastic elastomer (TPE). One suitable TPE material that may be used is manufactured by Advanced Elastomer Systems LP of Akron, Ohio under the trademark SANTOPRENE. It should be appreciated that the first and second strips 24, 32 may be formed from other suitable flexible materials.

In use, the nail fin 10 assumes a shipping position A (FIG. 3) in which the vertical leg 22 of inner or anchor portion 14 and the surrounding barbed elements 26 are forced into and frictionally retained in channel 28 formed in the outer surface of window frame assembly 30. The horizontal leg 20 and the outer or attachment portion 16 of fin 10 extend along the outer surface of the window frame assembly 30 with the sealing finger 38 engaged against the window frame assembly.

At a construction site, the nail fin 10 and window frame assembly 30 combination is used to properly align the window frame assembly 30 relative to a building support structure 34. To ready the nail fin 10 for attachment to the support structure 34, the outer or attachment portion 16 is folded or bent through about 45 degrees to an intermediate installation position B and then bent to a final installation position C lying at about a 90 degree angle to the plane of the outer surface of the window frame assembly 30. At this point, the second strip 32 defines the solid attachment template which identifies the preferred area where the attachment portion 16 is fastened to the building support structure 34 (FIGS. 6-7) such as by a nail or the like (not shown). The support structure 34 may include siding 42 attached to support beams 44. With the fastening of the attachment portion 16 to the support structure 34, the sealing finger 38 tightly engages the support surface 34 to prevent entry of moisture between the outer portion 16 and the support structure 34.

The present invention thus provides a nail fin 70 coextruded with a pair of thermoplastic elastomer strips 24, 32 which are used to facilitate enhanced sealing across hinge openings 18 and against a building support structure 34, and create a positive attachment template 36 and sealing finger 38 used in the installation of the fin 10 upon the support structure 34. The first strip 24 simultaneously seals the openings 18 forming the hinge, and creates an effective barbed insertion structure around the vertical leg 24 to facilitate and improve attachment to the window frame assembly 30. The second strip 32 defines a solid attachment template 36 which seals around a nail or other fastener driven into the support structure 34. At the same time, the second strip uses a finger 38 as a water tight seal against a vertical surface of the building structure 34. The thermoplastic elastomer on strips 24, 32 will withstand extreme temperatures and will not crack during use.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

We claim:

1. A nail fin used with a fenestration frame assembly fastened in a building support structure, the nail fin comprising:

a bendable metallic flange member having an anchor portion with a horizontal leg joined integrally at a single 90° angle to a vertical leg retained in the frame assembly, the anchor portion being pivotally connected to a straight attachment portion fastened flush against the support structure along a hinge defined by a series of spaced apart openings formed through the flange member, the metallic flange member being formed with a strip extending along outer surfaces of the attachment and anchor portions and an inner surface of the anchor portion covering and sealing the openings and simultaneously defining barbed elements around the vertical leg of the anchor portion, and wherein the attachment portion of the metallic flange member is formed with another strip separated from the strip covering the openings, extending continuously along the outer surface of the attachment portion and an inner surface of the attachment portion and defining a solid attachment template fastened to the support structure and forming a sealing finger disposed at an angle relative to the attachment portion and engaged against the support structure.

2. The nail fin of claim 1, wherein the flange member is constructed of galvanized steel.

3. The nail fin of claim 1, wherein the strip is constructed of thermoplastic elastomer.

4. The nail fin of claim 1, wherein both strips are constructed of thermoplastic elastomer.

5. A nail fin used to interconnect a peripheral frame assembly with a support structure, the nail fin comprising:

an L-shaped bendable member constructed of a substantially stiff material having a bent inner portion with a single 90° angle provided with a horizontal leg connected to a vertical leg and a straight outer portion with an inner end lying coplanar with the horizontal leg and pivotally interconnected with the inner portion by a hinge defined by a series of spaced apart openings formed through the bendable member;

a first strip covering the hinge and extending along outer surfaces of the outer portion, the horizontal leg and the vertical leg and an inner surface of the vertical leg for sealing the openings and integrally forming barbed elements only on the vertical leg that are frictionally retained in the peripheral frame assembly, and a separate second strip being provided continuously along inner and outer surfaces along an outer end of the outer portion for defining a solid attachment template fastened to the support structure and integrally forming a sealing finger at an angle against the support structure.

6. The nail fin of claim 5, wherein the bendable member is constructed of galvanized steel.

7. The nail fin of claim 5, wherein the first strip is constructed of a flexible thermoplastic elastomer extending along the outer surfaces of the outer portion, the horizontal and vertical legs and the inner surface of the vertical leg.

8. The nail fin of claim 5, wherein the first and second strips are constructed of a flexible thermoplastic elastomer extending along opposite ends of the bendable member.

9. The nail fin of claim 5, wherein the bendable member has a shipping position in which the outer portion lies along a flat outer surface of the peripheral frame assembly, and an installed position in which the outer portion is attached to the support structure at an angle of 90° degrees relative to the flat outer surface of the peripheral frame assembly.

10. The nail fin of claim 5, wherein the outer portion has a length which is longer than the inner portion.

11. The nail fin of claim 5, wherein the seal includes a portion that extends along an inner surface of the outer end.

12. The nail fin of claim 5, wherein the bendable member has a substantially uniform thickness throughout a length and a width thereof.

13. The nail fin of claim 5, wherein the bendable member is constructed of a material different than the first and second strips.

* * * * *